US005084847A

United States Patent [19]

Song

[11] Patent Number: 5,084,847

[45] Date of Patent: Jan. 28, 1992

[54] TIME DISPLAY CONTROL METHOD FOR AN ELECTRONIC MICROWAVE OVEN

[75] Inventor: Dai-hyun Song, Pusan, Rep. of Korea

[73] Assignee: Goldstar Co., Ltd., Seoul, Rep. of Korea

[21] Appl. No.: 626,206

[22] Filed: Dec. 10, 1990

[30] Foreign Application Priority Data

Dec. 28, 1989 [KR] Rep. of Korea ..... 89-19912

[51] Int. Cl.[5] ..... G04B 47/00; H05B 6/68

[52] U.S. Cl. ..... 368/10; 368/82; 219/10.55 B

[58] Field of Search ..... 368/72-74, 368/107-113, 250-251; 219/10.55 B

[56] References Cited

U.S. PATENT DOCUMENTS 4,484,065 11/1984 Ueda ..... 219/10.55 B
4,504,716 3/1985 Sakamoto ..... 219/10.55 B
4,661,690 4/1987 Eke ..... 219/10.55 B

*Primary Examiner*—Vit W. Miska
*Attorney, Agent, or Firm*—Anthony J. Casella; Gerald E. Hespos

[57] ABSTRACT

A method of controlling time display of an electronic microwave oven. The method is characterized in that the lapse of the time since the time of cooking completion is displayed, a beep emitter beeps regularly within a predetermined intervals for a predetermined period since a cooking is completed, and said method comprises; step of that, when the temperature-set cooking is performed and a cooking temperature reaches a set temperature, cooking completion flag is set; step of that lapse of time since the time of cooking completion is displayed and a beep emitter beeps regularly within a predetermined interval for a predetermined period; and step of that after lapse of predetermined period since the time of cooking completion, the operation stops.

8 Claims, 4 Drawing Sheets

TIME DISPLAY CONTROL METHOD FOR AN ELECTRONIC MICROWAVE OVEN

BACKGROUND OF THE INVENTION

The present invention relates to a method for controlling an electronic microwave oven, and more particularly to a method for controlling a time display of the electronic microwave oven in such a way that the electronic microwave oven can be rested for a given time duration after cooking operation is completed.

Electronic microwave ovens in general as shown in FIG. 1 consist a power supply device 2 for supplying power to a micro-processor (hereinafter referred to as MICOM) 1, a relay driver 3 for receiving output from the MICOM 1 and driving a relay, a key-entry device 6, a display driver 5, and a beep emitter driver 4.

In conventional method, when a cooking time is set, the time starts to decrement from the set time until 0 (zero) is displayed, and then 'End' is displayed followed by beeping of a beep emitter and either display of a current time or blinking of just a colon(:).

That is, as shown in FIG. 2, a one-second time flag F1 is checked for whether or not having a value of '1', and if the one-second time flag F1 is '1', whether or not a cooking is set is checked, and if the cooking is set, whether or not the cooking is being performed is checked, and if the cooking is being performed, whether or not the cooking is a temperature-set cooking, and if the cooking is not the temperature-set cooking, a value of '1' is subtracted from a set time data D2 to reset to a new time data D2, and then the newly set time data D2 is checked for whether or not having a value of '0', and if the newly set time data D2 is not '0', a time-set cooking is proceeded and if the newly set time data D2 is '0', 'End' is displayed and a beeping sound notifies completion of the cooking.

If the cooking is the temperature-set cooking, whether or not a set temperature is reached is checked, and if the set temperature is not reached, the temperature-set cooking is continued, and if the set temperature is reached, 'End' is displayed and a beeping sound notifying completion of the temperature-set cooking is outputted.

However, there is a setback in the prior art in that lapse of time since completion of a cooking cannot be known so that whether or not re-heating is necessary cannot be judged.

The prior art is also disadvantageous in that completion of the cooking is not repeatedly notified so that an operator of a microwave oven of the prior art cannot be reminded of the completion of the cooking.

SUMMARY OF THE INVENTION

It is therefore an object of the present invention to resolve such setback and disadvantage by providing a method for displaying lapse of time starting from completion of a cooking so that an operator can know when the cooking was completed and for notifying the operator of the completion of the cooking by beeping a beep emitter every five minutes starting from five minutes to 20 minutes so that the operator can be reminded of the completion of the cooking.

BRIEF DESCRIPTION OF THE DRAWINGS

For a better understanding of the invention and to show how the same may be carried into effect, reference will now be made, by way of example, to the accompanying diagrammatic drawings, in which.

DETAILED DESCRIPTION OF THE INVENTION

Figure 1:
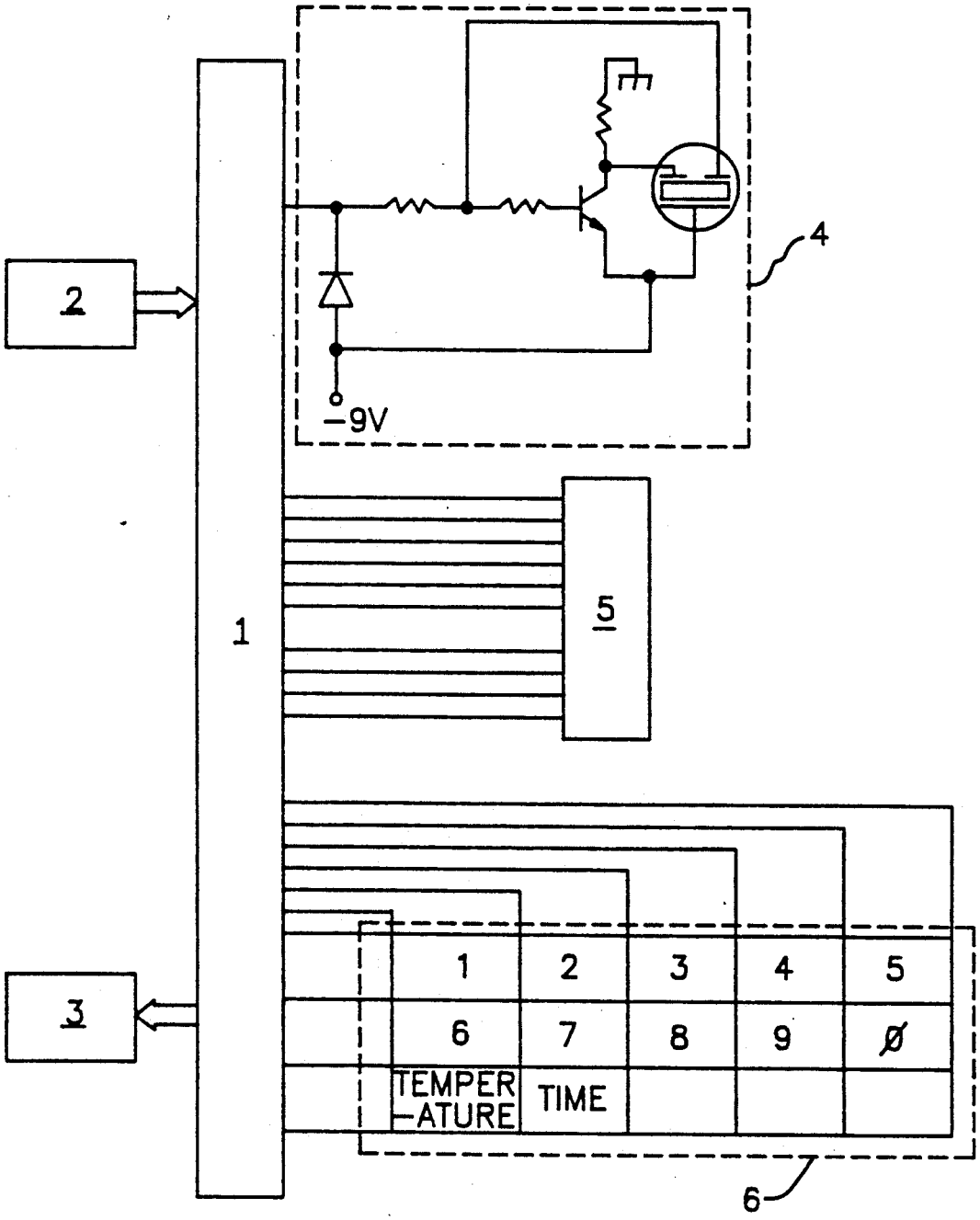
FIG. 1 (PRIOR ART)
FIG. 1 is a circuit diagram of a conventional electronic microwave oven.
Figure 2:
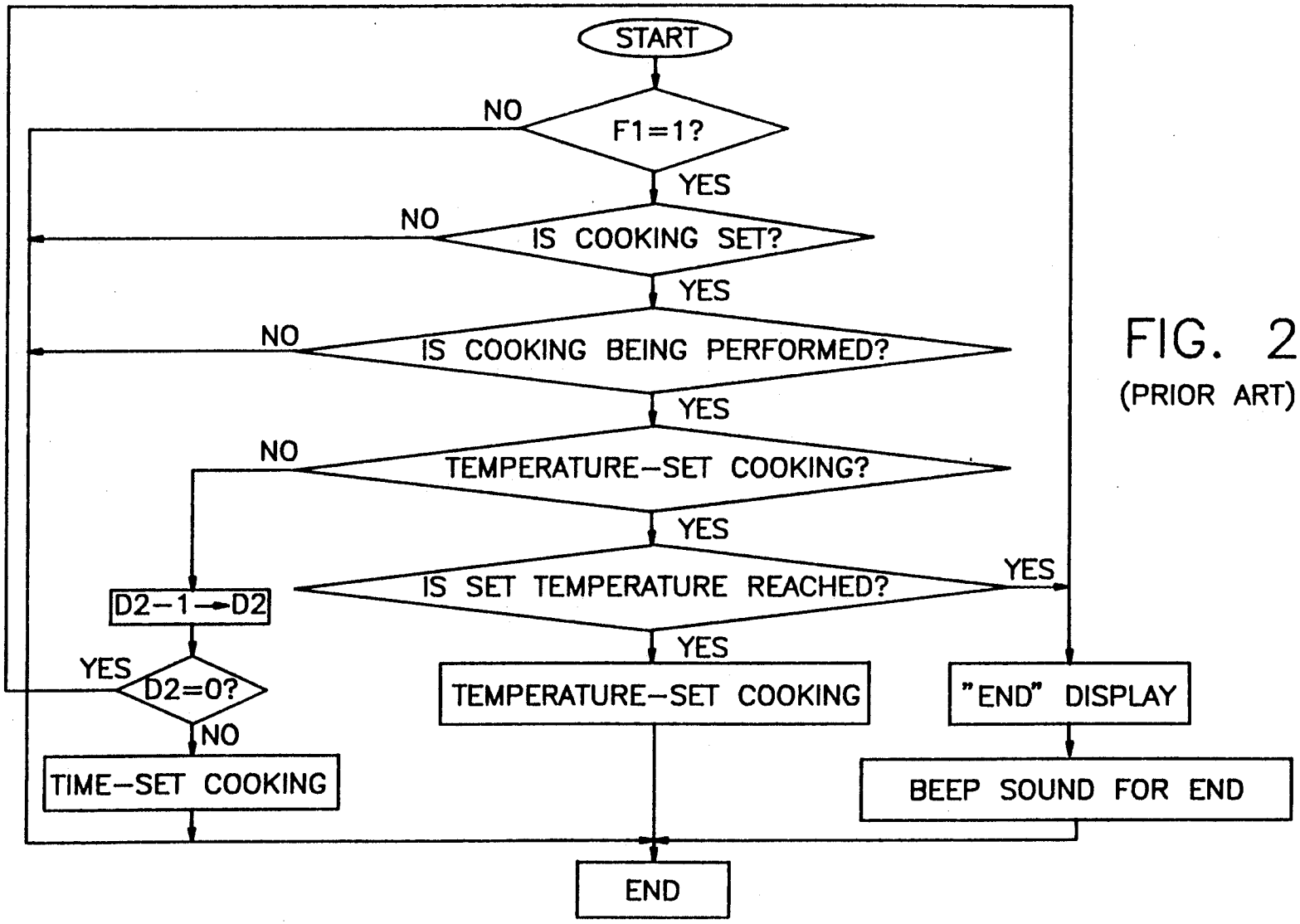
FIG. 2 (PRIOR ART)
FIG. 2 is a flow diagram of operation of an electronic microwave oven according to prior art.
Figure 3A:
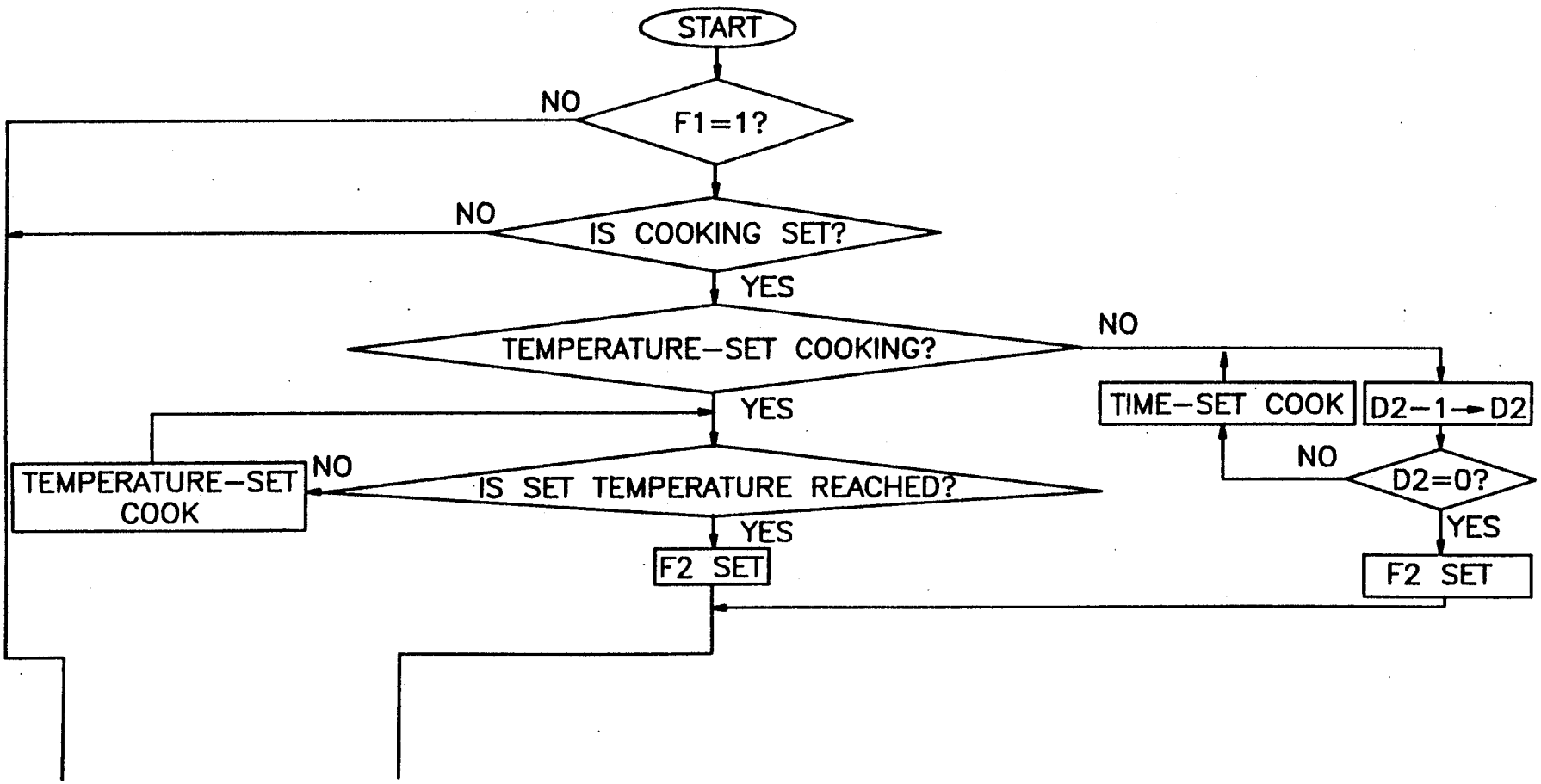
FIGS. 3A and 3B illustrate a flow diagram of operation of an electronic microwave oven according to the present invention.
Figure 3B:
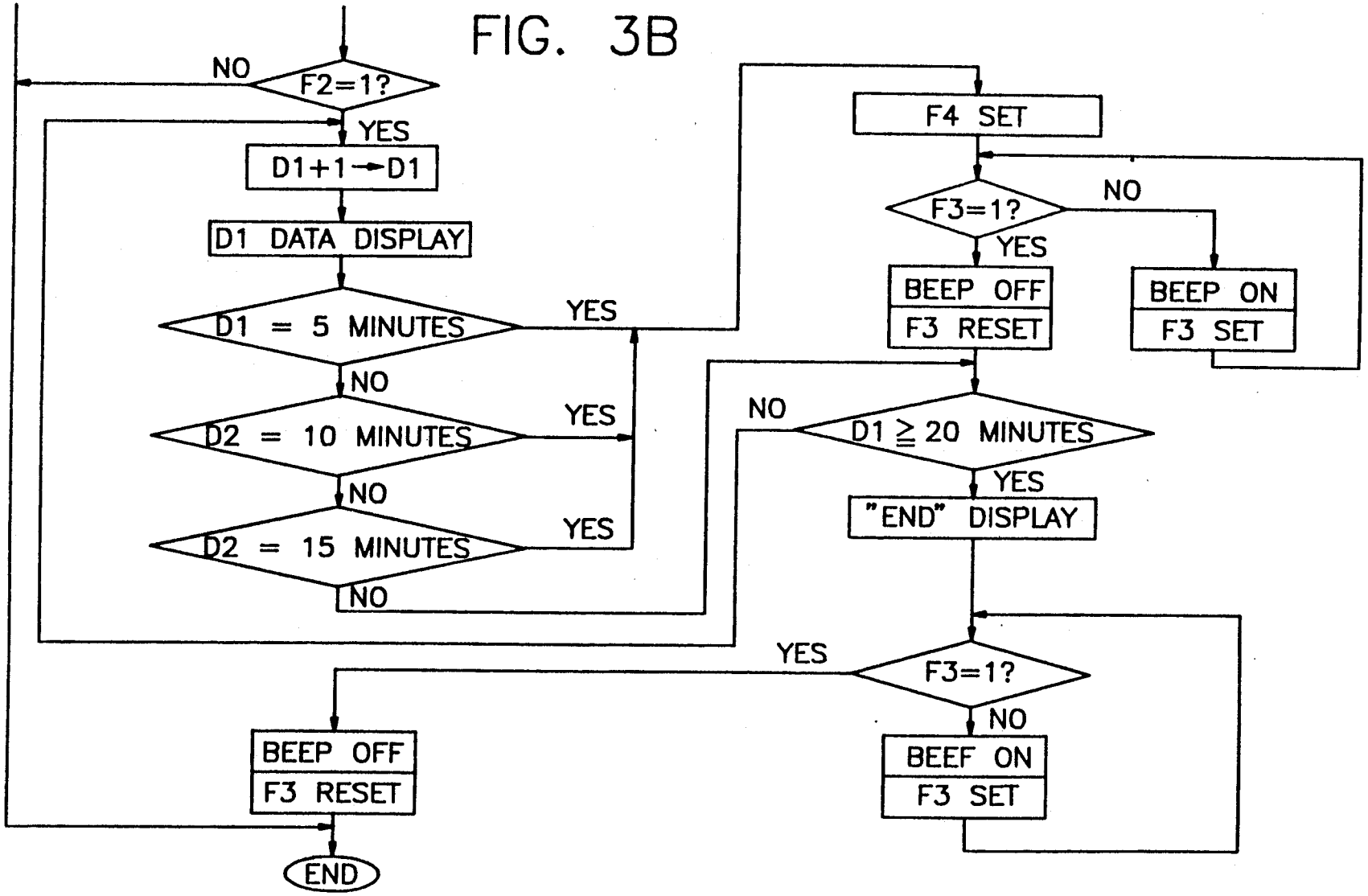

The present invention is now described in more detail with reference to FIG. 3.

When a start key is pressed, a one-second flag F1 is checked for whether or not having a value of '1', and if the one-second flag F1 is '1', whether or not a cooking is set is checked, and if the cooking is set, as described in the prior art whether or not the cooking is a temperature-set cooking is checked, and if the cooking is not the temperature-set cooking, a value of '1' is subtracted from a set time data D2 to re-set to a new time data D2 and the new time data D2 is checked for whether or not having a value of '0' (zero), and if the new time data D2 is '0' (zero), cooking completion flag F2 is set and the cooking completion flag F2 is checked for whether or not having a value of '1', and if the time data D2 is not '0' (zero), time-set cooking is proceeded and a step of decrementing the set time is returned and subsequent steps are repeated.

And if the cooking is the temperature-set cooking, whether or not a set temperature is reached is checked, and if the set temperature is not reached, the temperature-set cooking is proceeded and then whether or not set temperature is reached is checked again, and if the set temperature is reached, then the cooking completion flag F2 is set and whether or not the cooking completion flag F2 is '1' or not is checked.

And if the cooking completion flag F2 is '1' after whether or not the cooking completion flag F2 is 1 is checked, a value of a count-up data D1 after completion of cooking is incremented by one, and then the incremented value of the count-up data D1 is checked and at points where the incremented value of the count-up data D1 becomes five minutes, ten minutes, and 15 minutes a beep emitter count flag F4 is set, and then a beep emitted on/off flag F3 is checked for whether or not having a value of 1, and if the beep emitter on/off flag F3 is not 1, a beep emitter is set 'on' and then the beep emitter on/off flag F3 is set, and if the beep emitter on/off flag F3 is 1, the beep emitter is set 'off', the beep emitter on/off flag F3 is reset and then whether or not a value of the count-up data D1 after completion of cooking is greater than or equal to 20 minutes.

And if the value of the count-up data D1 after completion of cooking is not any of five minutes, ten minutes and 15 minutes, a step is followed in which whether or not the value of the count-up data D1 is greater than or equal to 20 minutes is checked.

And if the checked value of the count-up data D1 is smaller than 20 minutes, the step of checking the value of the count-up data D1 is repeated, and if the checked value of the count-up data D1 is greater than or equal to 20 minutes, 'End' is displayed, and then the beep emitter on/off flags F3 is checked for whether or not the beep emitter on/off flag F3 is 1, and if the beep emitter on/off flag is not 1, the beep emitter is set 'on' and after the beep emitter on/off flag F3 is set whether or not the beep emitter on/off flag F3 is 1 is checked, and if the beep emitter on/off flag F3 is 1, the beep emitter is set 'off', the beep emitter on/off flag F3 is reset, and then operation is put to a stop.

Therefore, as described in the foregoing, the present invention has an advantage that an operator is able to not only know a lapse of time after cooking has ended so that the operator can decide whether or not re-heating is necessary, but also be notified of completion of cooking every five minutes for a period of 20 minutes.

While the invention has been particularly shown and described with reference to a preferred embodiment, it will be understood by those skilled in the art that modifications in detail may be made without departing from the spirit and scope of the invention.

What is claimed:

1. A method of controlling time display for a microwave oven characterized by the steps of determining whether cooking is complete, generating a signal upon determining cooking completion and displaying the lapse of time since the time of cooking completion, whereby an operator of the microwave oven can observe the lapse of time since the cooking completion to determine whether a re-heating is necessary.

2. A method of controlling time display for a microwave oven according to claim 1, characterized by the further steps of providing a beep emitter and; emitting beeps regularly at a predetermined interval for a predetermined period of time after the cooking completion.

3. A method of displaying time for a microwave oven comprising the steps of:

selecting a parameter for determining completion of cooking;

starting cooking;

periodically checking to determine if the parameter for determining completion of cooking has been reached;

continuing cooking if the parameter has not been reached;

stopping cooking if the parameter has been reached and generating an audible signal indicating the completion of cooking;

generating a visual elapsed time signal for visually displaying the elapsed time since the completion of cooking;

comparing the elapsed time to selected values of elapsed time; and generating audible signals when the selected values of elapsed time have been reached, whereby the audible signals remind an operator of the microwave oven that cooking is complete, and whereby the visual displays of elapsed time since completion of cooking enable the operator to determine whether re-heating is necessary.

4. A method as in claim 3, wherein the selected values of elapsed time are five minutes, ten minutes and fifteen minutes after the completion of cooking.

5. A method as in claim 3 further comprising the steps of:

selecting a final elapsed time since the completion of cooking;

comparing the elapsed time to the selected final elapsed time and generating an end signal when the elapsed time equals the selected final elapsed time.

6. A method as in claim 5, wherein the selected final elapsed time equals twenty minutes.

7. A method as in claim 3, wherein the parameter for determining completion of cooking is a selected time from the start of cooking, and wherein the step of periodically checking to determine if the parameter has been reached comprises measuring the time from the start of cooking and periodically comparing the time from the start of cooking to the selected time for completion of cooking.

8. A method as in claim 3, wherein the parameter for determining completion of cooking is a selected temperature of an item being cooked, and wherein the step of periodically checking to determine if the parameter has been reached comprises measuring the actual temperature of the item being cooked and comparing the actual temperature of the item being cooked to the selected temperature for determining completion of cooking.

* * * * *